US008051588B2

(12) United States Patent
Ruby

(10) Patent No.: US 8,051,588 B2
(45) Date of Patent: Nov. 8, 2011

(54) CUTTING TOOTH FOR A TRENCH WALL CUTTER

(75) Inventor: Wilhelm Ruby, Waidhofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 12/700,267

(22) Filed: Feb. 4, 2010

(65) Prior Publication Data

US 2010/0205835 A1 Aug. 19, 2010

(30) Foreign Application Priority Data

Feb. 12, 2009 (DE) ..... 20 2009 001 814 U

(51) Int. Cl.
*E02F 9/28* (2006.01)

(52) U.S. Cl. ..... 37/452; 299/101; 299/83.1; 37/465

(58) Field of Classification Search ..... 37/452, 37/454, 465, 455, 446; 172/540, 554, 555; 299/82.1, 83.1, 101
See application file for complete search history.

(56) References Cited

U.S. PATENT DOCUMENTS

| | | | | | |
|---|---|---|---|---|---|
| 280,542 | A | * | 7/1883 | Whitcomb | 299/101 |
| 280,543 | A | * | 7/1883 | Whitcomb | 299/101 |
| 294,247 | A | * | 2/1884 | McDonald | 299/42 |
| 340,792 | A | * | 4/1886 | Legg | 299/101 |
| 895,387 | A | * | 8/1908 | Mercer | 299/101 |
| 1,286,008 | A | * | 11/1918 | Hughes | 299/83.1 |
| 1,322,819 | A | * | 11/1919 | Pratt | 299/82.1 |
| 2,005,016 | A | * | 6/1935 | Van Buskirk | 37/452 |
| 2,049,171 | A | * | 7/1936 | Osgood | 299/35 |
| 2,595,565 | A | * | 5/1952 | Buttrick | 299/108 |
| 2,690,904 | A | | 10/1954 | Muschamp et al. | |
| 2,745,655 | A | * | 5/1956 | Vojtush | 299/101 |
| 3,300,883 | A | * | 1/1967 | Troeppl et al. | 37/454 |
| 3,312,002 | A | * | 4/1967 | Benetti | 37/452 |
| 3,484,844 | A | * | 12/1969 | Petersen | 37/457 |
| 3,629,964 | A | | 12/1971 | Russel | |
| 3,755,933 | A | | 9/1973 | Lowrey | |
| 3,841,709 | A | * | 10/1974 | Kniff | 299/101 |
| 4,320,925 | A | * | 3/1982 | Bowes, Jr. | 299/101 |
| 5,092,659 | A | | 3/1992 | Grathoff | |
| 5,810,449 | A | | 9/1998 | Grathoff | |
| 6,270,164 | B1 | | 8/2001 | Seitle et al. | |
| 7,178,273 | B2 | | 2/2007 | Arzberger | |
| 7,578,080 | B2 | | 8/2009 | Stoetzer et al. | |
| 2008/0283257 | A1 | * | 11/2008 | Edwards | 172/256 |

FOREIGN PATENT DOCUMENTS

| | | | |
|---|---|---|---|
| DE | 1749015 | U | 7/1957 |
| DE | 3920011 | C3 | 6/1996 |
| DE | 19547170 | C2 | 12/1997 |
| EP | 0916771 | A2 | 5/1999 |
| EP | 1452686 | A1 | 9/2004 |
| EP | 1780375 | A1 | 5/2007 |
| GB | 714251 | A | 8/1954 |
| GB | 2053315 | A | 2/1981 |

* cited by examiner

*Primary Examiner* — Robert Pezzuto
*Assistant Examiner* — Jamie L McGowan
(74) *Attorney, Agent, or Firm* — Jacobson Holman PLLC

(57) ABSTRACT

The invention relates to a cutting tooth for a trench wall cutter having a tongue-shaped tooth base for reception in a cutting wheel, whereby the tongue-shaped tooth base has a circumferentially surrounding holding groove, and at least one cutter which is arranged at the head-side of the tooth base. Provision is made for the cutting tooth with the tooth base and the cutter to be designed mirror-symmetrically to a plane of symmetry so that at least two opposite arranged cutters are present on the tooth base.

11 Claims, 2 Drawing Sheets

CUTTING TOOTH FOR A TRENCH WALL CUTTER

BACKGROUND OF THE INVENTION

1. Field of the Invention

The invention relates to a cutting tooth for a trench wall cutter having a tongue-shaped tooth base for reception in a cutting wheel, whereby the tongue-shaped tooth base has a circumferentially surrounding holding groove, and at least one cutter which is arranged at the head-side of the tooth base. Such a cutting tooth is designed with a tongue-shaped tooth base for reception in a cutting wheel, whereby the tongue-shaped tooth base has a circumferentially surrounding holding groove, and with at least one cutter which is arranged at the head-side of the tooth base.

2. Description of Related Art Including Information Disclosed Under 37 CFR §§1.97 and 1.98

Cutting teeth of such type are known for example from EP 1 780 375 A1 as well as from EP 0 916 771 A2.

The known cutting teeth are inserted with their tooth bases into cutting tooth holders that are provided circumferentially on the cutting wheel. In order to secure the respective cutting tooth in the cutting tooth holder in a direction lying transversely to the cutting direction, a surrounding holding groove is provided circumferentially on the tooth base, into which a corresponding profile on the cutting tooth holder engages. For the removal of soil material the cutting teeth have cutters that are arranged at the head-end of the tooth base.

DE 1 749 015 U, DE 39 20 011 C3, DE 195 47 170 C2, GB 714,251, GB 2 053 315 A, U.S. Pat. No. 2,690,904, U.S. Pat. No. 4,120,106, U.S. Pat. No. 5,810,449 and EP 1 452 686 A1 describe tooth arrangements for cutting wheels, in which case the cutting wheels are provided for alternating directions of rotation. The tooth arrangements have movable elements, whose position relative to the cutting wheel is changed upon alternation of the direction of rotation.

U.S. Pat. No. 3,629,964 and U.S. Pat. No. 3,755,933 describe chisel inserts for working the soil that can be mounted in different positions.

BRIEF SUMMARY OF THE INVENTION

The object of the invention is to improve a generic cutting tooth such that an especially wide variety of applications accompanied by high reliability, high efficiency and long service life are rendered possible.

The object is solved in accordance with the invention by a cutting tooth for a trench wall cutter having a tongue-shaped tooth base for reception in a cutting wheel, whereby the tongue-shaped tooth base has a circumferentially surrounding holding groove, and at least one cutter which is arranged at the head-side of the tooth base, wherein the cutting tooth with the tooth base and the cutter is designed mirror-symmetrically to a plane of symmetry so that at least two opposite arranged cutters are present on the tooth base.

In the case of a cutting tooth according to the invention provision is made for the cutting tooth with the tooth base and the cutter to be designed mirror-symmetrically to a plane of symmetry so that at least two opposite arranged cutters are present on the tooth base.

A fundamental idea of the invention resides in the fact that the cutting tooth has a mirror-symmetrical design so that both the tongue-shaped tooth base and the cutters are arranged symmetrically to the same mirror plane. As a result of this arrangement according to the invention a cutting tooth having at least two opposite lying cutters that cut in opposed directions is provided. In this way, even on reversal of direction of rotation of the cutting wheel the cutting tooth according to the invention can always be brought into cutting engagement with the in-situ soil. This mode of operation proves to be especially interesting in the so-called "cutter soil mixing method" in which, for producing hardened trench wall panels, the cut-off soil material is mixed in the trench with a binding agent by the action of the cutting wheels. The reversing direction of rotation of the cutting wheels allows for a particularly good mixing of the settable suspension. Though, due to the alternating direction of rotation of the cutting wheels the cut-off soil material can be broken down and crushed further.

Moreover, the use of a cutting tooth according to the invention renders it possible that in the case of unilateral wear of the tooth caused by an unchanged direction of rotation of the cutting wheel the tooth can be turned around on the cutting wheel, making the second cutter available for further operation. By doing so, the service life can be increased significantly. Through the use of the second cutter the teeth can be employed for a considerably longer period of time which can bring about a substantial saving of costs and time.

A tongue-shaped tooth base can be understood in particular as a tooth base that is U-shaped in side view and/or as a tooth base that has a rectangular center part and a semicircular base part in side view. In accordance with the invention the cutters are arranged at the head-side of the tooth base facing away from the semicircular base part. For best suitability, the cutters according to the invention are carbide cutters.

A trench wall cutter can be understood in particular as a cutter having a frame, at the underside of which cutting wheels are arranged, which, when the frame is lowered vertically into the ground, can cut off soil material below the frame and produce a trench thereby. Advantageously, the cutting wheels of the trench wall cutter together have a rectangular cutting cross-section. In particular, at least four cutting wheels can be provided. These four cutting wheels are advantageously arranged in the form of two cutting wheel pairs, in which case the two cutting wheels of each cutting wheel pair have a common axis of rotation. It is useful for the two common axes of rotation to be arranged parallel and, by preference, each of the cutting wheels of a cutting wheel pair is aligned with a cutting wheel of the adjacent cutting wheel pair.

According to the invention it is particularly preferred that the plane of symmetry runs perpendicular to a U-shaped side surface of the tooth base. As a result, an especially compact and at the same time robust tooth arrangement can be attained. Advantageously, the plane of symmetry runs at least approximately perpendicular to the cutting direction of the cutters and/or through a longitudinal axis of the tooth base.

Additionally or alternatively, however, a plane of symmetry disposed parallel to the U-shaped side surface of the tooth base can be provided, too.

Therefore, it is of particular advantage that the cutting tooth is designed mirror-symmetrically to a further plane of symmetry, which runs perpendicular to the aforementioned plane of symmetry. This enables an especially uniform application of force and therefore an especially good cutting effect.

Furthermore, with regard to the cutting performance it is particularly advantageous for the cutters to be designed at least in areas in a polyhedral manner. More particularly, an exposed area of the cutters can have a polyhedral design.

Advantageously, the cutters each have at least one cutting edge. On this cutting edge the respective cutter can be designed in a wedge-shaped manner. Each cutter can also have several cutting edges. In particular, provision can be made for several cutting edges of the cutters to converge on a cutter tip. For an especially good cutting progress it is of advantage that at least one cutting edge is provided which runs at least approximately parallel to the plane of symmetry, i.e. which includes an angle of <20° together with the plane of symmetry.

It is especially preferred that the cutting tooth has at least one head-side W-profile, which preferably extends across both opposite arranged cutters. In accordance with this embodiment the cutting tooth, especially when seen from a side view and/or from a viewing direction parallel to the plane of symmetry, has at its head-side at least one W-shaped edge that is formed in areas by the two opposite lying cutters, in particular by cutting edges of the cutters. Such a W-profile permits a reliable fixing of the cutters on the tooth base. At the same time, this arrangement can allow for a reversing rotational operation of the cutting wheel without the need for providing the cutting tooth in a movable manner on the cutting wheel.

A particularly compact and robust arrangement is provided in that the plane of symmetry of the cutting tooth runs through a center vertex of the head-side W-profile and/or in that the outer flanks of the head-side W-profile are formed at least in areas by the cutters. In particular, the outer flanks can be formed by wedge-shaped cutting edges of the cutters. The inner flanks of the head-side W-profile are advantageously formed by the tooth base, in particular by wedge-shaped edges of the tooth base.

The cutting tooth according to the invention can be used for a cutting wheel operation effected in a reversing manner without the need for the tooth to be supported in a movable manner on the cutting wheel. Therefore it is especially advantageous that the cutters are arranged immovably on the tooth base and/or that the tooth base is arranged immovably on the cutting wheel.

Another preferred embodiment of the invention resides in the fact that the two cutters are each designed as double cutters, in particular with parallel cutting edges. According to this embodiment the two opposite lying cutters each have two individual cutting elements that are preferably connected. For best suitability, the individual cutters are designed at least in areas in a polygonal-like manner. For an especially uniform application of force the double cutters have parallel cutting edges, i.e. at least one of the cutting edges of one of the individual cutters is designed parallel to a cutting edge of the other individual cutter of the respective double cutter. Advantageously, the double cutters have several parallel cutting edges.

An especially robust arrangement is provided in that the two individual cutters of a double cutter are arranged adjacent and preferably rest against each other. Advantageously, the double cutters are each designed in one piece. The individual cutters can, in particular, have a wedge-shaped design.

If double cutters are provided it is of particular advantage that the double cutters have, by preference at least when seen in a direction perpendicular to the plane of symmetry, a W-shaped profile. For best suitability, the left flanks of the W-shaped profile can be formed by a first individual cutter and the right flanks of the W-shaped profile can be formed by a second individual cutter of the same double cutter. As a result, an especially robust arrangement is on hand. By preference, cutting edges are designed on the off-center vertices of the W-shaped profile.

It is especially advantageous that the W-shaped profile of the double cutters is continued in the tooth base and preferably runs through the plane of symmetry. According to this embodiment a W-profile is present both in the section of the double cutters and in the section of the head-side tooth base portion that joins the double cutters.

Alternatively or additionally it is of advantage that the double cutters, when viewing the tooth head from above and/or when seen parallel to the plane of symmetry, have a W-shaped profile.

The mechanical load-bearing capacity of the cutting tooth can be increased further in that on the tooth base in the area of the cutters at least one pyramidal cutter support structure is provided. Advantageously, each individual cutter has a pyramidal cutter support structure. For best suitability, the supported cutter rests against a pyramidal outer surface of the cutter support structure. The cutter support structure can, in particular, have the shape of an inclined pyramid. More particularly, a rectangular pyramid, preferably a square pyramid can be provided.

For an especially easy-to-realize and at the same time reliable securing of the cutting tooth on a cutting tooth holder it is of particular advantage that the circumferentially surrounding holding groove has a triangular cross-section. The corresponding fixing element on the tooth holder can then have a corresponding triangular profile.

A further preferred embodiment of the invention resides in the fact that the tooth base has two holding bores that are arranged mirror-symmetrically to the plane of symmetry and provided for fixing the cutting tooth on the cutting wheel. Through these holding bores holding bolts can be inserted that secure the tooth base on the cutting tooth holder. In particular, provision can be made for the cutting tooth to be secured on the cutting tooth holder by just one single bolt that is inserted through one of the holding bores. The mirror-symmetrical arrangement of the two holding bores makes it possible to turn the tooth around on the cutting tooth holder and also to use the same bolt arrangement with the cutting tooth being turned around. For an especially easy fixing the holding bores can penetrate the holding groove at least partially. In this case, the bolts can be secured in the fixing element of the cutting wheel, which corresponds with the holding groove.

In addition, it is of advantage that in the tooth base a tool bore for an extraction tool is provided. By way of this bore, into which an extraction bolt can be inserted for example, a force can be applied to the tooth base with which the tooth base can be released from the related cutting tooth holder. Advantageously, the axis of the tool bore is disposed in the plane of symmetry. In this way, an unnecessary weakening of the tooth base by the tool bore is prevented. By preference, the tool bore is offset with respect to the holding bores towards the tooth head.

The invention also relates to a construction machine, in particular a trench wall cutter, having at least one cutting wheel on which at least one cutting tooth according to any one of the preceding claims is arranged.

BRIEF DESCRIPTION OF THE SEVERAL VIEWS OF THE DRAWINGS

In the following the invention will be described in greater detail by way of a preferred exemplary embodiment shown schematically in the accompanying figures, wherein.

DETAILED DESCRIPTION OF THE INVENTION

Figure 1:
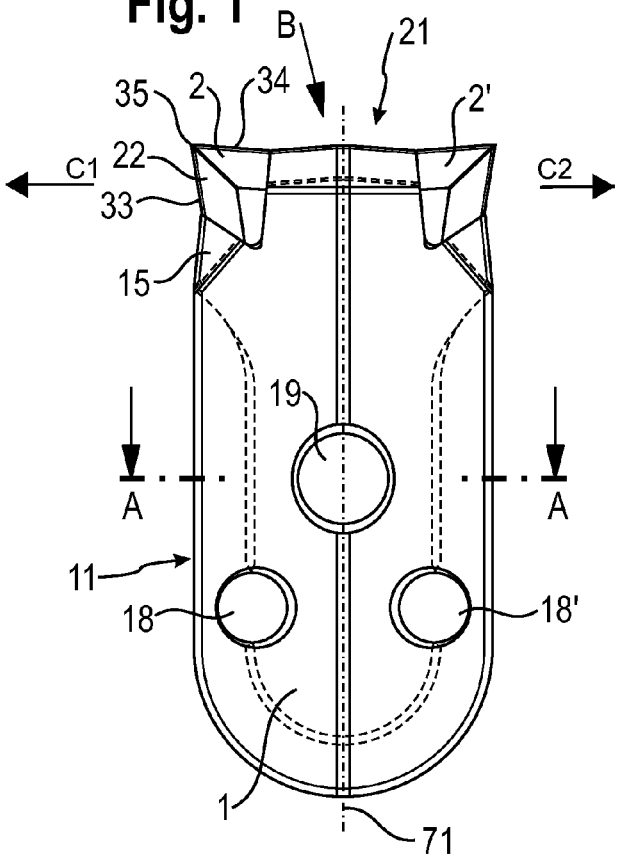
FIG. 1 shows a side view.
Figure 2:
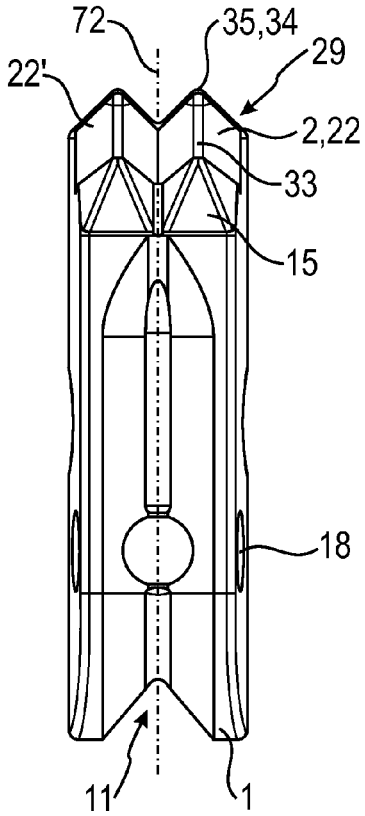
FIG. 2 shows a front view.
Figure 4:
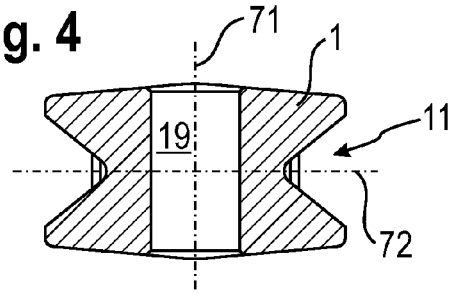
FIG. 4 shows a sectional view A-A of FIG. 1.

The cutting tooth shown in the figures has a tongue-shaped tooth base 1 that is designed in a U-shaped manner in side view (FIG. 1). There, the tooth base 1 is surrounded circumferentially by a holding groove 11 which also has a U-shaped design. As shown in FIGS. 2 and 4 in particular, the holding groove 11 has a triangular profile in cross-section that extends as far as into the tooth base 1. In the front view of FIG. 2 the tooth base 1 is limited by two parallel side surfaces that run longitudinally of the tooth base from bottom to top.

At the head-side of the tooth base 1, i.e. on the side depicted at the top in FIGS. 1 and 2 that faces away from the vertex of the U-profile of the tooth base 1, a cutter 2, 2' is in each case arranged on opposite sides of the tooth base. The cutters 2, 2' are each designed as double cutters and as such have two wedge-shaped individual cutters. In the figures only the individual cutters 22, 22' of the cutter 2 are provided with reference signs. The second cutter 2' is designed in analogy with two individual cutters.

The individual cutters 22, 22' each have a double-wedge structure with two wedges that run approximately perpendicular to and merge into each other, with each of the two wedges defining a cutting edge 33 and 34 respectively (FIG. 1). The lateral cutting edge 33 and the upper cutting edge 34 each converge on a cutter tip 35 of the related individual cutter 22.

Laterally on the tooth base 1 in the area of the cutters 2, 2' two pyramidal cutter support structures 15 are each formed. Each of the cutter support structures 15 supports respective one of the individual cutters 22. For this purpose the respective individual cutter 22 rests against an outer surface of the respective cutter support structure 15. In the area of the structures 15 designed in the shape of a rectangular pyramid the tooth base has a taper in order to prevent unnecessary wear of the tooth base.

In the tooth base two holding bores 18, 18' running parallel to each other are provided that partially penetrate the holding groove 11 (FIGS. 1 and 2). In addition, a tool bore 19 for an extraction tool is provided centrally on the tooth base 1.

The entire cutting tooth, including the tooth base 1, the cutters 2, 2', the holding bores 18, 18' and the tool bore 19, is designed minor-symmetrically to a first plane of symmetry 71 (FIGS. 1 and 4). In FIG. 1 this plane of symmetry runs perpendicular to the drawing plane and in FIG. 2 it runs parallel to the drawing plane from tooth head to tooth base. On account of the minor symmetry to the plane of symmetry 71 the cutting tooth is suitable for a cutting operation effected in opposed cutting directions C1 and C2 (towards the left and the right, respectively, in FIG. 1).

Figure 3:
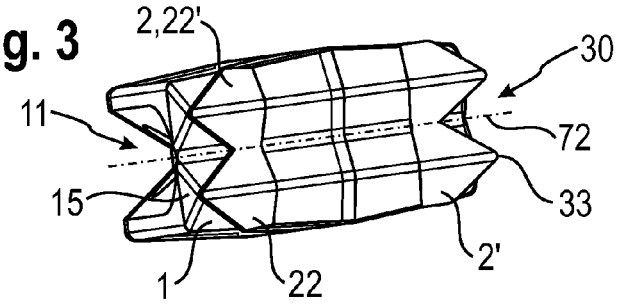
FIG. 3 shows a top-side view in the direction B of FIG. 1.

In addition, the cutting tooth is also designed minor-symmetrically to a second plane of symmetry 72 (FIGS. 2, 3 and 4). The second plane of symmetry 72 runs perpendicular to the first plane of symmetry 71 from tooth head to tooth base. In contrast to the first plane of symmetry 71 that is spaced from the cutters 2, 2' the second plane of symmetry 72 runs through the cutters 2, 2', namely between the two individual cutters 22 and 22' in a parallel fashion to the drawing plane of FIG. 1 and perpendicular to the drawing plane of FIG. 2.

As can be seen in FIG. 1 in particular, the cutting tooth has a head-side W-profile 21. This W-profile is formed on the outside by the two cutters 2, 2' and on the inside by the tooth base 1. The center vertex of the W-profile 21 lies in the plane of symmetry 71. The outer flanks of the W-profile are formed by the upper cutting edges 34 of the two cutters 2 and 2' respectively.

Figure 5:
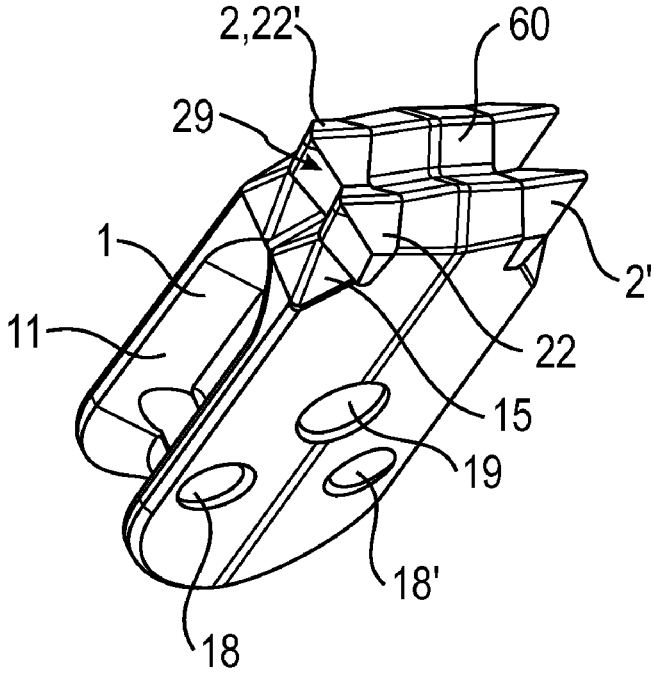
FIG. 5 shows a perspective view from above.
Figure 6:
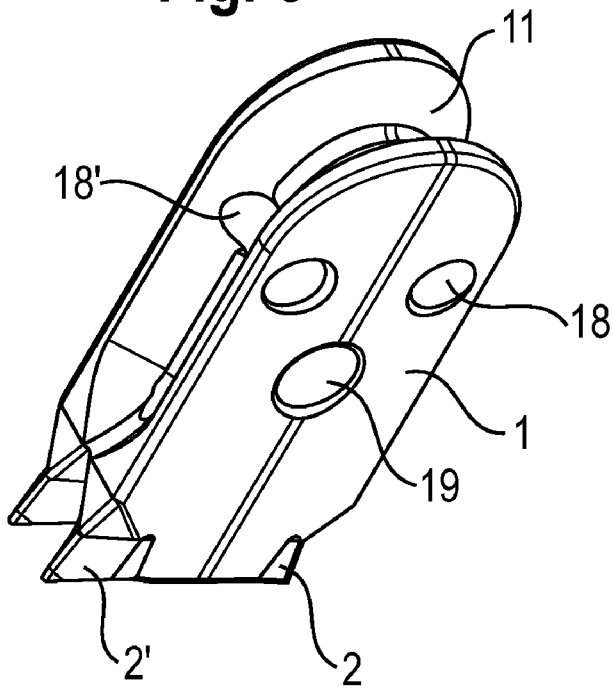
FIG. 6 shows a perspective view from below of an embodiment of a cutting tooth according to the invention.

As depicted in FIG. 2 in particular, in the front view of the cutting tooth, i.e. when seen in the cutting direction of the cutters 2 (FIG. 2), the two individual cutters 22, 22' form with their wedge structures another W-shaped profile 29. This inverted W-shaped profile 29 protrudes from the top side of the tooth head. The off-center vertices of the W-shaped profile 29 are formed by the upper cutting edges 34. As illustrated in FIG. 5, this inverted W-shaped profile 29 extends across the entire head-side of the cutting tooth, which means that the W-shaped profile 29 is present both in the area of the cutters 2, 2' and in the head-side tooth base area 60 that lies between the cutters 2, 2'.

Another inverted W-shaped profile 30 is present in top view (FIG. 3). This profile 30, which protrudes from the front side of the tooth head, is formed by the second wedge shape of the double wedge structure of the two individual cutters 22, 22', which means that the off-center vertices of the further W-shaped profile 30 are formed by the lateral cutting edges 33.

During operation the cutting tooth is received in a cutting tooth holder of a cutting wheel not depicted. To this end a corresponding profile element engages in the holding groove 11 and secures the cutting tooth on the cutting tooth holder. To fix the cutting tooth a holding bolt can then be inserted into one of the two holding bores 18 or 18'. The cutting wheel is then set into rotation and in doing so the cutter 2 or 2' positioned in front in the cutting direction removes in-situ soil material.

The invention claimed is:

1. Cutting tooth for a trench wall cutter, the cutting tooth having opposed cutting directions and a primary plane of symmetry approximately perpendicular to the opposed cutting directions and comprising:

a tongue-shaped tooth base for reception in a cutting wheel, wherein the tongue-shaped tooth base has a head-side and a circumferentially surrounding holding groove, and at least two cutters arranged on the tooth base opposite each other at the head-side of the tooth base on opposite sides of the primary plane of symmetry, wherein the cutting tooth has a mirror symmetric configuration with respect to the primary plane of symmetry, wherein:

the cutting tooth has at least one head-side W-shaped profile, which extends across the at least two cutters, the plane of symmetry of the cutting tooth runs through a center vertex of the at least one head-side W-shaped profile, the outer flanks of the at least one head-side W-shaped profile are formed by the at least two cutters, and the at least two cutters are each configured as double cutters with parallel cutting edges, and the double cutters have, when seen perpendicular to the plane of symmetry, a W-shaped profile.

2. Cutting tooth according to claim 1, wherein the plane of symmetry runs perpendicular to a U-shaped side surface of the tooth base.

3. Cutting tooth according to claim 1, wherein the cutting tooth is mirror symmetric with respect to a second plane of symmetry, which runs perpendicular to the primary plane of symmetry.

4. Cutting tooth according to claim 1, wherein the cutters are designed at least in areas in a polyhedral manner and each have at least one cutting edge.

5. Cutting tooth according to claim 1, wherein
the cutters are arranged immovably on the tooth base and the tooth base is arranged immovably on a cutting wheel.

6. Cutting tooth according to claim 1, wherein
the W-shaped profile of the double cutters is continued in the tooth base and runs through the plane of symmetry.

7. Cutting tooth according to claim 1, wherein
on the tooth base in the area of the cutters at least one pyramidal cutter support structure is provided.

8. Cutting tooth according to claim 1, wherein
the circumferentially surrounding holding groove has a triangular cross-section.

9. Cutting tooth according to claim 1, wherein
the tooth base has two holding bores that are arranged mirror-symmetrically to the primary plane of symmetry for fixing the cutting tooth on the cutting wheel.

10. Cutting tooth according to claim 1, wherein
in the tooth base a tool bore for an extraction tool is provided, wherein the axis of the tool bore lies in the plane of symmetry.

11. A trench wall cutter, having at least one cutting wheel on which at least one cutting tooth according to claim 1 is arranged.

* * * * *